US007226320B2

(12) United States Patent
Abe et al.

(10) Patent No.: US 7,226,320 B2
(45) Date of Patent: Jun. 5, 2007

(54) CONNECTOR HAVING AN IMPROVED LOCKING STRUCTURE

(75) Inventors: Kimihiro Abe, Makinohara (JP); Tohru Ikumi, Makinohara (JP); Syuji Kimura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/397,679

(22) Filed: Apr. 5, 2006

(65) Prior Publication Data

US 2006/0228941 A1 Oct. 12, 2006

(30) Foreign Application Priority Data

Apr. 12, 2005 (JP) ..... P2005-114976

(51) Int. Cl.
*H01R 24/04* (2006.01)

(52) U.S. Cl. ..... 439/668; 439/736; 439/595

(58) Field of Classification Search ..... 439/578, 439/595, 668, 669, 736, 750
See application file for complete search history.

(56) References Cited

U.S. PATENT DOCUMENTS

| | | | | |
|---|---|---|---|---|
| 5,913,694 | A * | 6/1999 | Wright | 439/394 |
| 6,254,430 | B1 * | 7/2001 | Endo et al. | 439/578 |
| 6,364,705 | B1 * | 4/2002 | Yamamoto | 439/595 |
| 6,517,379 | B2 * | 2/2003 | Leve | 439/578 |
| 6,554,644 | B2 * | 4/2003 | Koide | 439/585 |
| 6,860,760 | B2 * | 3/2005 | Endo et al. | 439/578 |

FOREIGN PATENT DOCUMENTS

| | | |
|---|---|---|
| JP | 2004-55426 A | 2/2004 |
| JP | 2004-200019 A | 7/2004 |

* cited by examiner

*Primary Examiner*—Thanh-Tam Le
(74) *Attorney, Agent, or Firm*—Sughrue Mion, PLLC

(57) ABSTRACT

A connector includes an electrically conductive plug provided with a retaining hole, and an insulating housing that has a retaining member shaped in a cantilever beam. The retaining member has a retaining claw portion. The retaining claw portion has a projecting portion formed at a proximal end side of the retaining member. The projecting portion is crashed by an edge portion of the retaining hole when the retaining claw portion is engaged with the retaining hole.

4 Claims, 10 Drawing Sheets

CONNECTOR HAVING AN IMPROVED LOCKING STRUCTURE

BACKGROUND OF THE INVENTION

This invention relates to a connector (for example, an antenna plug for an automobile) including an electrically-conductive plug pin functioning as a center contact, an insulating housing of an insulative nature fixed to an outer side of the plug pin, and an electrically-conductive outer contact fixed to an outer side of the insulating housing.

A related connector is disclosed in JP-A-2004-200019. In FIGS. 8 and 9, the connector 101, used for example as an automotive antenna plug, comprises an electrically-conductive plug pin 102 functioning as a center contact, an insulating housing 103 of an insulative nature fixed to an outer side of the plug pin 102, and an electrically-conductive outer contact 104 fixed to an outer side of the insulating housing 103. The connector 101 is designed to be electrically connected to an end portion of a coaxial cable 105.

The coaxial cable 105 comprises a center conductor 106 serving as a core wire, an insulator (not shown) serving as a dielectric, a braided conductor 107 serving as an outer conductor, and an insulating sheath 108 serving as an outer covering.

Here, the structure of the connector 101 will be briefly described with reference to its assembling procedure. In FIG. 10, the plug pin 102 is press-fitted into a pin insertion hole 109 of the insulating housing 103 from a front end side thereof as indicated by arrow P. At this time, this press-fitting operation is carried out while an engagement notch 110 of the plug pin 102 is disposed in registry with an engagement rib 111 of the insulating housing 103. In FIG. 11, when a front end portion of the engagement rib 111 is brought into abutting engagement with a front end surface of the engagement notch 110, thereby positioning the plug pin 102 relative to the insulative housing 103, retaining projections 112 bite into the engagement rib 111. As a result, the plug pin 102 is fixed to the inner side of the insulating housing 103.

The insulating housing 103, having the plug pin 102 fixedly mounted therein, is inserted into the outer contact 104 from a front end side thereof as indicated by arrow Q. At this time, this inserting operation is carried out while engagement projecting tabs 113 of the outer contact 104 are disposed in registry with guide grooves of the insulating housing 103, respectively. When distal ends of the engagement projecting tabs 113 slide past engagement step portions 115 of the insulating housing 103, respectively, the engagement projecting tabs 113 are engaged respectively with the engagement step portions 115 as shown in FIG. 9. Also, a front end edge of a contact body 116 abuts against projections 117 of the insulating housing 103 as shown in FIG. 9. As a result, the outer contact 104 is fixed to the outer side of the insulating housing 103.

When the insulating housing 103, having the plug pin 102 fixedly mounted therein, is thus inserted into the outer contact 104, an inner surface of the contact body 116 of the outer contact 104 presses retaining beams 118 of the insulating housing 103, so that retaining claws 119 of the retaining beams 118 are moved inwardly as indicated by arrows R in FIG. 11. As a result, the retaining claws 119 are engaged respectively in retaining holes 120 of the plug pin 102, thereby fixing the plug pin 102 to the inner side of the insulating housing 103, as shown in FIG. 9.

As will be appreciated from the foregoing description, the fixing of the plug pin 102 to the insulating housing 103 is effected by the fixing structure (in which the retaining projections 112 are brought into biting engagement with the engagement rib 111 as a result of press-fitting of the plug pin 102 into the insulating housing 103) and the fixing structure in which the retaining claws 119 are brought into retaining engagement with the respective retaining holes 120 as a result of inserting of the insulating housing 103 into the outer contact 104.

Next, the connection of the connector 101 to the coaxial cable 105 will be described. In FIGS. 8 and 9, a connecting portion 121 of the connector 101 includes a first engaging contact piece portion 122 and second engaging contact piece portions 123. Each of the first and second engaging contact piece portion 122 and 123 is in the form of a strip-like piece portion, and these piece portions 122 and 123 are bent inwardly such that their distal end portions are fitted or engaged together as shown in FIG. 12. More specifically, the second engaging contact piece portions 123 jointly assume a bifurcated shape. The first engaging contact piece portion 122 is inserted between the second engaging contact piece portions 123. That portion of each of the second engaging contact piece portions 123, disposed adjacent to its distal end, is bent to form a recessed portion 124 for positioning the center conductor 106 of the coaxial cable 105.

In FIG. 9, the axial cable 105, having the exposed center conductor 106 and braided conductor 107, is inserted into the outer contact 104 from a proximal end side thereof, and the center conductor 106 is placed on the first engaging contact piece portion 122 and the second engaging contact piece portions 123.

After the center conductor 106 is thus placed on the first and second engaging contact piece portions 122 and 123, the braided conductor 107 is positioned between pressing projections 127 of a jig 126 inserted through a connection notch 125 in the insulating housing 103, as shown in FIG. 13. Then, in this condition, the jig 126 is pressed down. As a result of pressing-down of the jig 126, the first engaging contact piece portion 122 and each second engaging contact piece portion 123 are moved away from each other, and at the same time the center conductor 106 is pressed down to be guided into the recessed portions 124 of the second engaging contact piece portions 123.

When the jig 126 is removed upwardly, the first engaging contact piece portion 122 and the second engaging contact piece portions 123 tend to be restored into their respective original shapes because of their own resilient forces, so that the center conductor 106, received in the recessed portions 124, is held between the first engaging contact piece portion 122 and the second engaging contact piece portions 123 as shown in FIG. 13. Thus, the electrical connection between the center conductor 106 and the plug pin 102 is completed.

In this condition in which the electrical connection between the center conductor 106 and the plug pin 102 is completed, inner press-clamping piece portions 128 of the outer contact 104 are inserted between the insulator (not shown) and braided conductor 107 of the coaxial cable 105, and in this condition, when outer press-clamping piece portions 129 are press-fastened, the braided conductor 107 of the coaxial cable 105 is fixed to the outer contact 104, and therefore is electrically connected thereto. Then, when sheath press-clamping piece portions 130 of the outer contact 104 are press-fastened onto the insulating sheath 108 of the coaxial cable 105, the whole of the connecting-side end portion of the axial cable 105 is fixed to the outer contact 104.

Finally, a covering piece portion 131 of the outer contact 104 is bent inwardly to cover the upper side of the connecting portion 121 of the connector 101, thereby isolating the plug pin 102 from the exterior, thus completing the series of assembling operations of the connector 101.

Thereafter, when the connector 101, connected to the coaxial cable 105, is fitted into a mating connector (for example, an automotive antenna socket) (not shown), the plug pin 102 contacts a signal terminal of the mating connector, and also a plurality of resilient contact piece portions 132 of the outer contact 104 contact a grounding terminal of the mating connector. As a result, the electrical connection between the connector 101 and the mating connector is completed.

The connector 101 is of such a structure that the first engaging contact piece portion 122 and the second engaging contact piece portions 123 directly grip or hold the center conductor 106 of the coaxial cable 105 therebetween, and the electrical connection is effected by this gripping condition. The following structures other than this structure have been proposed. For example, in the case of connecting a coaxial cable having an electronic part provided at its center conductor, techniques, disclosed for example in JP-A-2004-55426, can be used.

JP-A-2004-55426 discloses the coaxial cable having the electronic part provided at its center conductor. This publication also discloses a structure of connecting the coaxial cable, having the electronic part at its center conductor, to a connector. JP-A-2004-55426 will be described in a little more detail. The electric part has a pair of leads, and one of the leads is connected by soldering to the center conductor. The other lead is connected by soldering to a plug pin of the connector.

Further, a structure, not employing soldering, is disclosed in JP-A-2004-55426. Namely, an electronic part has a pair of leads, and one of the leads is connected by press-clamping to a center conductor. The other lead is also connected by press-clamping to a plug pin of a connector.

According to the technique disclosed in JP-A-2004-200019, there is provided the structure in which the retaining claws 119 of the insulating housing 103 are retainingly engaged in the respective retaining holes 120 of the plug pin 102, thereby fixing the plug pin 102 to the insulating housing 103. Generally, in the retaining structure using the retaining claws 119 and the retaining holes 120, each retaining hole 120 is set to a size slightly larger than the size of the retaining claw 119, so that fitting play or backlash is provided therebetween. The fitting play is necessary for smoothly bringing each retaining claw 119 into retaining engagement with the retaining hole 120.

In this structure having the fitting play, the plug pin 102 is allowed to move. Therefore, there is encountered a problem that the pressure of contact of the plug pin with the center conductor 106 of the coaxial cable 105 can not be sufficiently increased. When the contact pressure can not be sufficiently increased, a contact resistance increases.

And besides, according to the technique disclosed in JP-A-2004-200019, there is provided the structure in which the center conductor 106 of the coaxial cable 105 is gripped by the first engaging contact piece portion 122 and the second engaging contact piece portions 123 of the connector 101, thereby effecting the connection. Therefore, when the center conductor 106 can not be gripped by a sufficient gripping force, there is encountered a problem that the connecting reliability is lowered. Furthermore, the structure, having the first engaging contact piece portion 122 and the second engaging contact piece portions 123, is complicated as can be seen from FIGS. 12 and 13, and therefore this structure invites a problem that the productivity of the connector 101 is low.

On the other hand, in the technique disclosed in JP-A-2004-55426, the lead of the electronic part is connected to the plug pin by the connecting structure employing the soldering or the press-clamping. Therefore, in the case of the soldering, there is encountered a problem that the efficiency of the operation is very low. In the case of the press-clamping, there is encountered a problem that the reliability of connection of the lead to the plug pin is low (In the case where a single wire such as a lead is connected by press-clamping, it is difficult to obtain a proper press-clamped shape. Incidentally, in the case where a material of which the lead is made is harder than the plug pin, there are encountered problems such as a increased contact resistance value and a reduced adhering force.).

SUMMARY OF THE INVENTION

This invention has been made in view of the above circumstances, and an object of the invention is to provide a connector having a high connecting reliability. Another object is to provide a connector having high productivity and a high operation efficiency.

The above object has been achieved by a connector of the invention comprising:

an electrically conductive plug provided with a retaining hole; and an insulating housing that has a retaining member shaped in a cantilever beam, the retaining member having a retaining claw portion, wherein the retaining claw portion has a projecting portion formed at a proximal end side of the retaining member; and wherein the projecting portion is crashed by an edge portion of the retaining hole when the retaining claw portion is engaged with the retaining hole.

In the invention having the above features, at the time when the retaining claw portion of the retaining member of the insulating housing is inserted into the retaining hole of the plug so as to fix the plug to the insulating housing in a retained manner, the projecting portion, formed at the retaining claw portion, is crushed by the edge portion of the retaining hole. As a result of crushing of the projecting portion, the retaining claw portion is retainingly engaged in the retaining hole with no backlash or play developing therebetween. Therefore, the plug pin is fixed to the insulating housing in such a manner that no relative motion will occur therebetween. In the invention, the projecting portion is formed at the retaining claw portion of the retaining member of the insulating housing, and with this construction the relative motion of the plug can be prevented. As a result, a pressure of contact of the plug with the center conductor of the coaxial cable can be sufficiently increased.

Preferably, a width of the retaining claw portion is greater than a width of the retaining hole. In the invention having this feature, by determining the dimensional relation between the retaining claw portion and the retaining hole, the projecting portion can be positively crushed by the edge portion of the retaining hole.

Preferably, the edge portion of the retaining hole is chamfered. In the invention having this feature, by forming the chamfered portion on the edge portion, the crushing of the projecting portion can be smoothly carried out. As a result, the plug can be fixed to the insulating housing in a retained manner without lowering the efficiency of the operation.

Preferably, the electrically conductive plug is provided with a press-contacting connecting portion for connection to a center conductor of a coaxial cable or for connection to a lead of an electronic part connected to the center conductor. In the invention having this feature, the connector is connected via the press-contacting connecting portion of the plug pin to the coaxial cable or the coaxial cable having the electronic part provided at its center conductor. By adopting the connecting structure depending for its function on the press-contacting connection, the connector can be simplified in structure, and besides the efficiency of the operation can be enhanced.

In view of the above, there is achieved an advantage that the connector of a high connecting reliability can be provided. There can be achieved an advantage that the relative motion of the plug can be more positively prevented. Further, there is achieved an advantage that the plug pin can be fixed to the insulating housing in a retained manner without lowering the efficiency of the operation. Furthermore, there is achieved an advantage that the connector, having high productivity and the high operation efficiency, can be provided.

BRIEF DESCRIPTION OF THE DRAWINGS

The above objects and advantages of the present invention will become more apparent by describing in detail preferred exemplary embodiments thereof with reference to the accompanying drawings, wherein:

FIG. 3A is a side-elevational view, and FIG. 3B is a bottom view;

FIG. 8A is a plan view, and FIG. 8B is view as seen in a direction of arrow C;

DETAILED DESCRIPTION OF THE PREFERRED EMBODIMENTS

Figure 1:
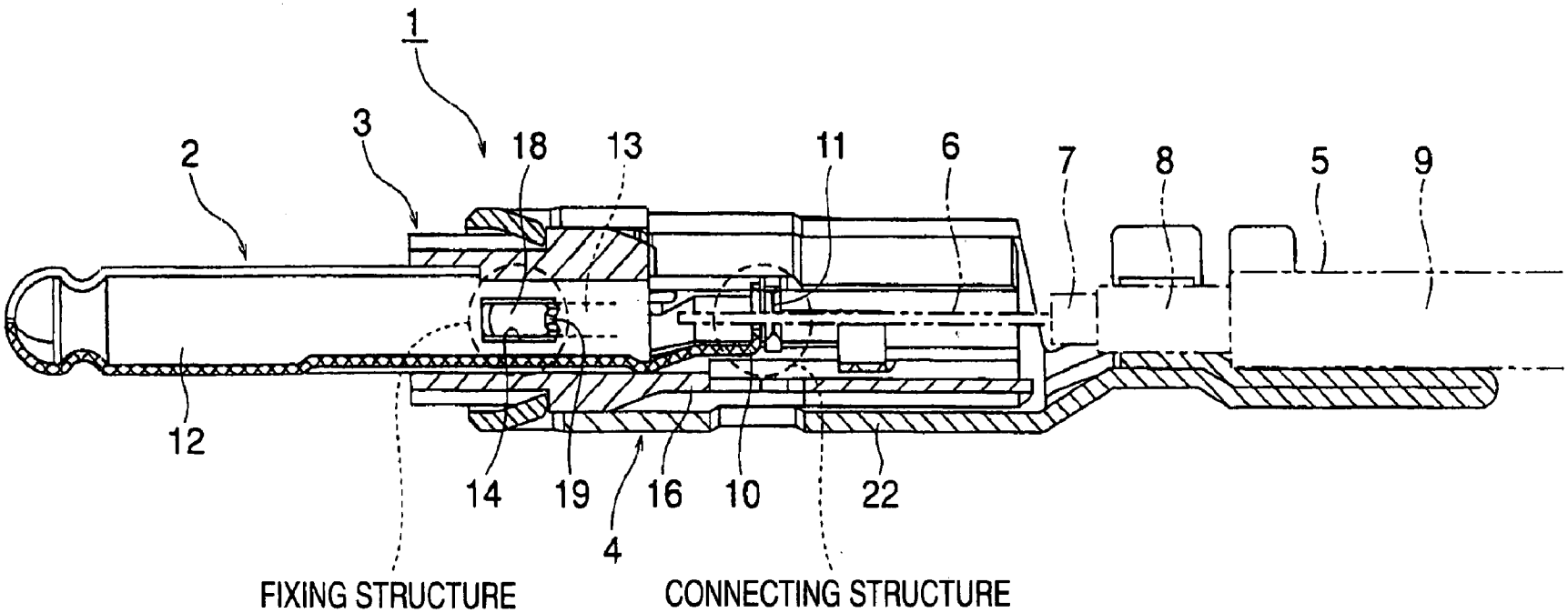
FIG. 1 is a cross-sectional view showing one preferred embodiment of a connector of the present invention.
Figure 2:
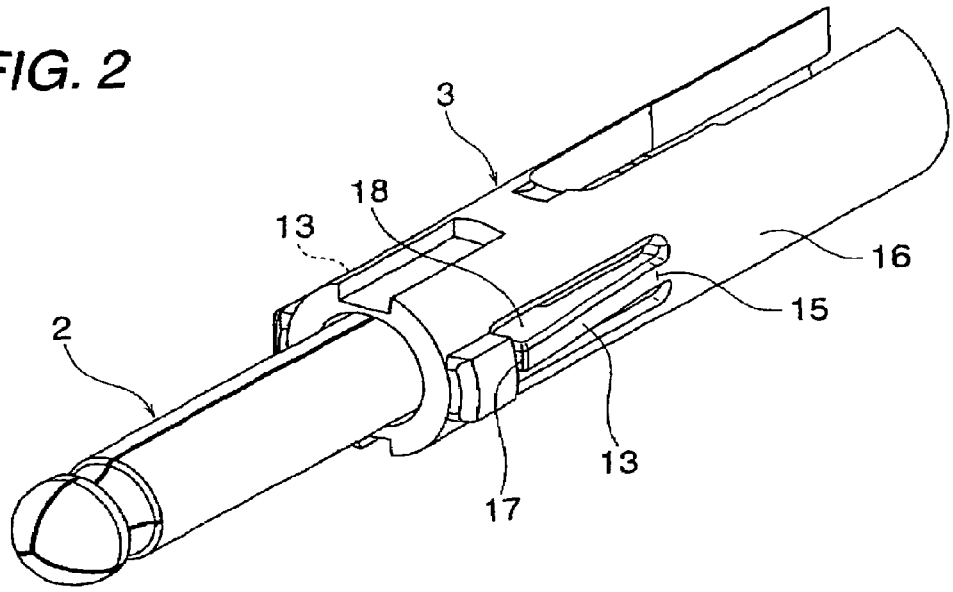
FIG. 2 is a perspective view showing a plug pin and an insulating housing.
Figure 3A:
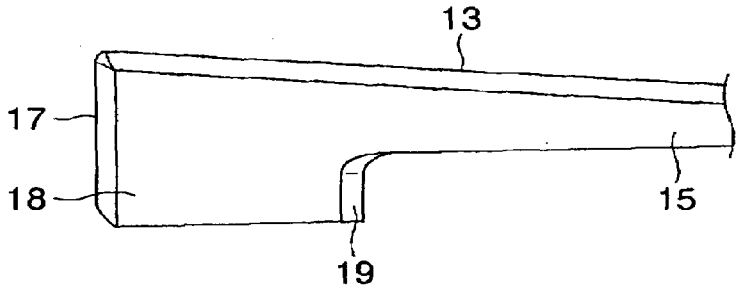
FIGS. 3A and 3B are views showing a retaining beam having a retaining claw.
Figure 3B:
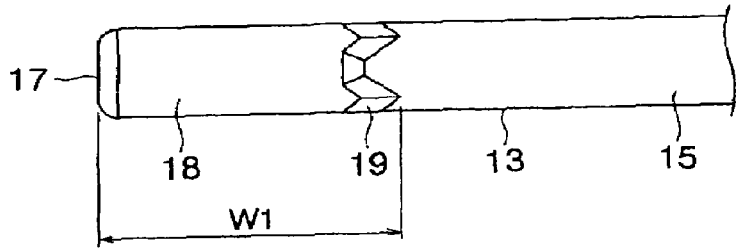
Figure 4:
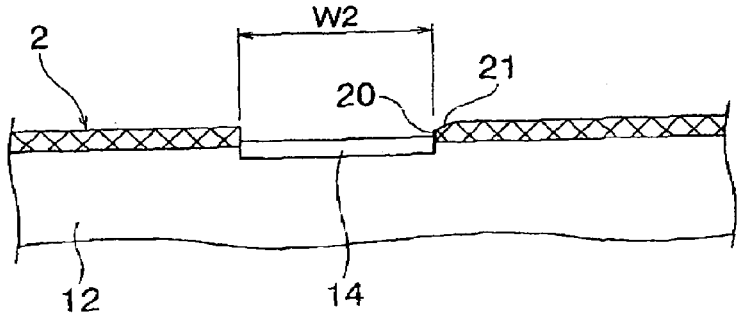
FIG. 4 is a cross-sectional view showing a retaining hole.
Figure 5:
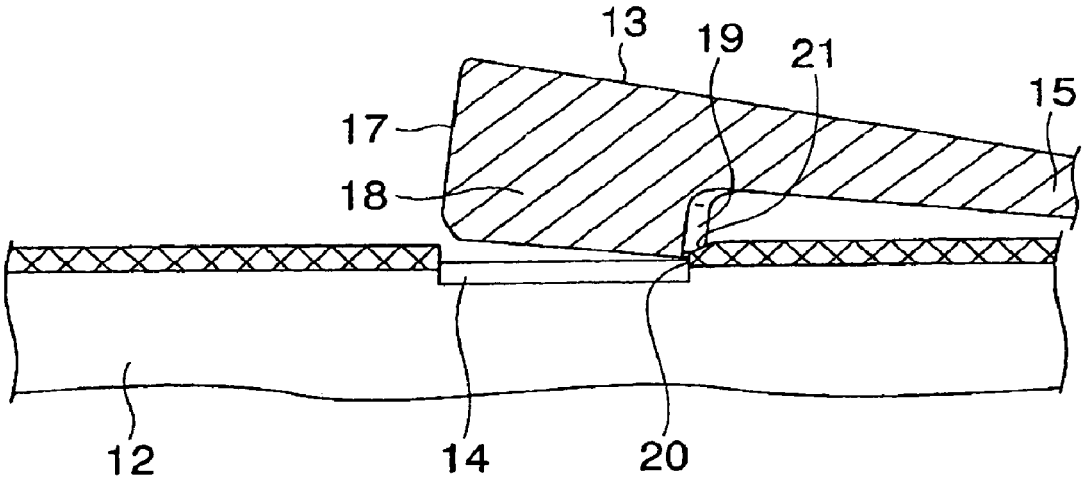
FIG. 5 is a cross-sectional view showing a condition just before the retaining claw is inserted into the retaining hole.
Figure 6:
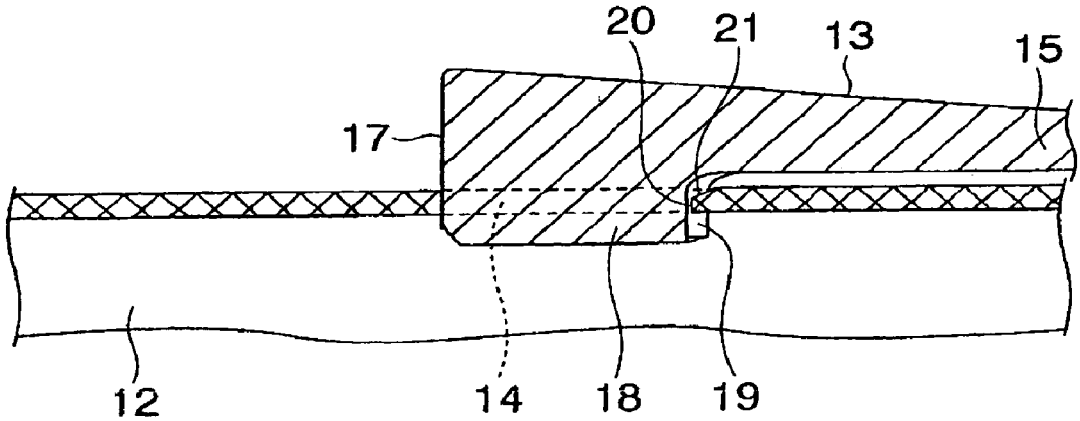
FIG. 6 is a cross-sectional view showing a condition in which the retaining claw is retainingly engaged in the retaining hole.

The present invention will now be described with reference to the drawings. FIG. 1 is a cross-sectional view showing one preferred embodiment of a connector of the invention. FIG. 2 is a perspective view showing a plug pin and an insulating housing, FIGS. 3A and 3B are views showing a retaining beam having a retaining claw, FIG. 4 is a cross-sectional view showing a retaining hole, FIG. 5 is a cross-sectional view showing a condition just before the retaining claw is inserted into the retaining hole, and FIG. 6 is a cross-sectional view showing a condition in which the retaining claw is retainingly engaged in the retaining hole.

In FIG. 1, reference numeral 1 denotes the connector of the invention used for example as an automotive antenna plug. The connector 1 of the invention includes the electrically-conductive plug pin 2 functioning as a center contact, the insulating housing 3 of an insulative nature fixed to an outer side of the plug pin 2, and an electrically-conductive outer contact 4 fixed to an outer side of the insulating housing 3. The connector 1 of the invention is designed to be electrically connected to an end portion of a coaxial cable 5.

The coaxial cable 5 includes a center conductor 6 serving as a core wire, an insulator 7 serving as a dielectric, a braided conductor 8 serving as an outer conductor, and an insulating sheath 9 serving as an outer covering.

The connector 1 of the invention is characterized by a connecting structure (that is, a portion encircled by a broken line in the drawings) of connecting the connector to the coaxial cable 5. The connector 1 of the invention is also characterized by a fixing structure (that is, a portion encircled by a broken line in the drawings) of fixing the plug pin 2 to the insulating housing 3. The two characteristic portions will be described hereafter (The other structure than the two characteristic portions is basically the same as that of the conventional example. Therefore, detailed explanation of the other structure than the two characteristic portions will be omitted.).

In the connector 1 of the invention, a press-contacting connecting structure is used as the connecting structure of connecting the connector to the coaxial cable 5. The press-contacting connecting structure is provided by forming a press-contacting connecting portion 11 at a connecting portion 10 of the plug pin 2. The connecting portion 10 of the plug pin 2 is formed on and extends from a rear portion of a pin body 12. The press-contacting portion 11 comprises a pair of press-contacting blades. A gap between the pair of press-contacting blades is slightly smaller than a diameter of the center conductor 6.

In this press-contacting connecting structure, when the center conductor 6 is inserted between the pair of press-contacting blades by the use of a predetermined jig (not shown), the inserted center conductor 6 is press-contacted by the pair of press-contacting blades (The electrical connection and the fixing are effected by this press-contacting.). This press-contacting operation can be carried out in the same process in which an operation for press-clamping the connector to the braided conductor 8 is effected. Therefore, in this connecting structure, the time and labor, required for the connecting operation can be reduced as compared with the conventional structure. The press-contacting connecting structure is simple in construction, and with respect to the reliability of connection to the center conductor 6, the stability of a contact surface is high because of press-contacting of the single wire, so that the increase of a contact resistance value can be suppressed.

Next, the fixing structure of fixing the plug pin 2 to the insulating housing 3 will be described with reference to FIGS. 1 to 6. The fixing structure is formed on the plug pin 2 and the insulating housing 3. The cantilever-like retaining beams 13 are formed on the insulating housing 3. The retaining beams 13 serve to retain the plug pin 2 to fix the plug pin 2 to the insulating housing 3. On the other hand, the retaining holes 14 are formed respectively in those portions of the plug pin 2 corresponding respectively to the retaining beams 13.

There are provided two retaining beams 13 and two retaining holes 14 although the number of the retaining beams, as well as the number of the retaining holes 14, is not particularly limited. The two retaining beams 13, as well as the two retaining holes 14, are circumferentially spaced an angle of 180° from each other.

Each retaining beam 13 is integrally connected at its proximal end 15 to a cylindrical body 16 of the insulating housing 3. A retaining claw 18 is formed at a distal end 17 of the retaining beam 13, and can project into an internal space of the body 16. The retaining beam 13 is formed into such a shape that this retaining beam 13 gradually projects outwardly from the body 16 in a direction from its proximal end 15 toward its distal end 17. The retaining claw 18 is in the form of a projection of a generally rectangular shape. A projecting portion 19, forming an important portion of the fixing structure, is formed on that side or surface of the retaining claw 18 disposed close to the proximal end 15 of the retaining beam 13.

The projecting portion 19 is formed into such a shape as to be crushed by an edge portion 20 (described later) of the retaining hole 14. A specific example of shapes of the projecting portion 19 (which is only one example) is a double-mountain like shape as shown in FIG. 3. The projecting portion of such mountain-like shape can be easily crushed since its apex-side portion is reduced in thickness.

A width W1 of the retaining claw 18, including the projecting portion 19, is set to a value larger than a width W2 of an opening of the retaining hole 14. Namely, the dimensional relation between the width W1 and the width W2 is so determined that the projecting portion 19 can be positively crushed when the retaining claw 18 is inserted into the retaining hole 14.

The retaining hole 14 has a rectangular shape, and is formed through a wall of the pin body 12. The retaining hole 14 has four edge portions that constitute the rectangular shape. One edge portion 20 among the four edge portions, that is, the edge portion 20 corresponding to the projecting portion 19, has a chamfered portion (a chambered edge) 21. Because of the formation of the chamfered portion 21, the edge portion 20 is smaller in thickness than the other edge portions. The chamfered portion 21 is provided for facilitating the crushing of the projecting portion 19. The provision of the chamfered portion 21 is arbitrary.

In the above construction, when each retaining beam 13 of the insulating housing 3 is pressed by an inner surface of a contact body 22 of the outer contact 4, the retaining claw 18 of the retaining beam 13 is moved inwardly as shown in FIGS. 5 and 6 (A procedure of assembling the connector is basically the same as that of the conventional example.). As a result, the retaining claw 18 is engaged in the retaining hole 14 in the plug pin 2 as shown in FIG. 6. At this time, the projecting portion 19 is crushed by the edge portion 20 of the retaining hole 14. As a result, the plug pin 2 is fixed to the inner side of the insulating housing 3 in such a manner that no relative motion will occur therebetween.

As described above with reference to FIGS. 1 to 6, the connector 1 of the invention has the fixing structure which eliminates a relative motion between the plug pin 2 and the insulating housing 3. Therefore, even if an excessive tensile stress acts on the plug pin 2 at the time of disconnecting the connector 1 from a mating connector (for example, an automotive antenna socket) (not shown), a load will not act on the portion forming the press-contacting connecting structure (the structure of connecting the connector to the coaxial cable 5), and a stable contact pressure can always be secured. Therefore, the increase of a contact resistance value can also be suppressed. Advantages of the press-contacting connecting structure (which is another feature of the connector 1 of the invention) are as described above.

Figure 7:
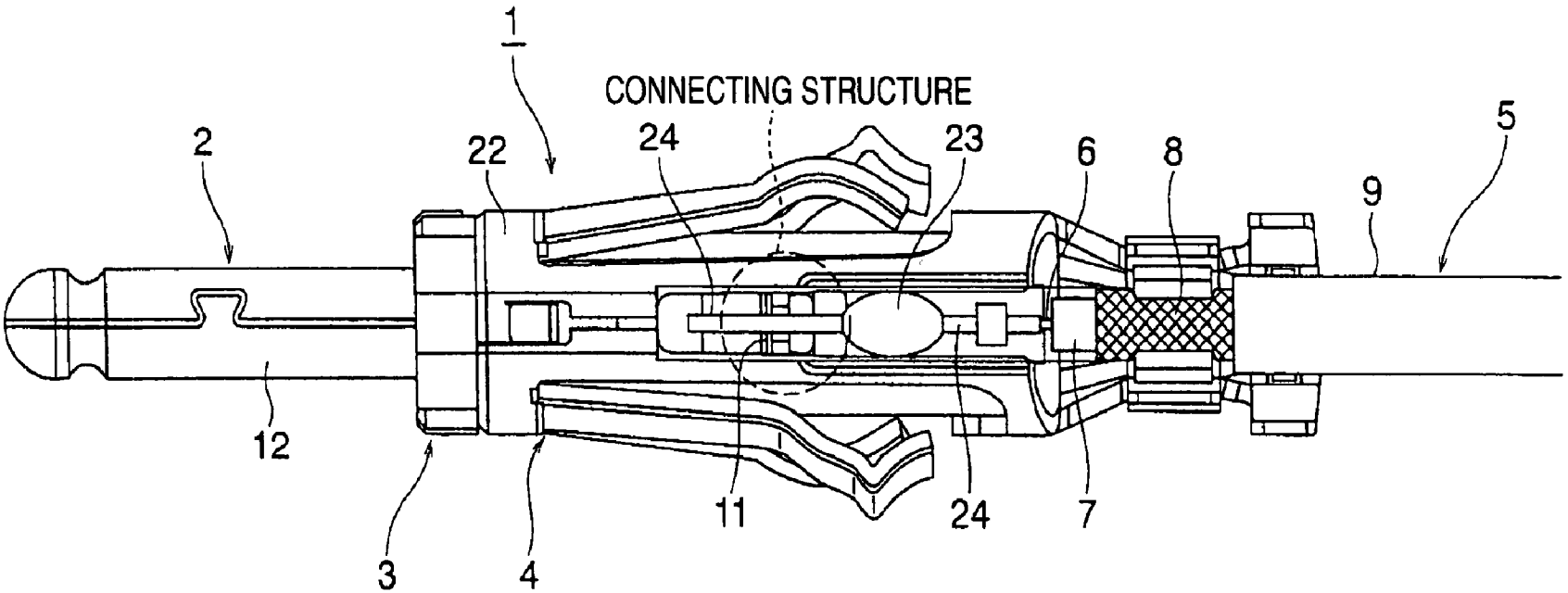
FIG. 7 is a plan view showing a condition in which a coaxial cable, having an electronic part provided at its central conductor, is connected by press-contacting to the connector of the invention.
Figure 8A:
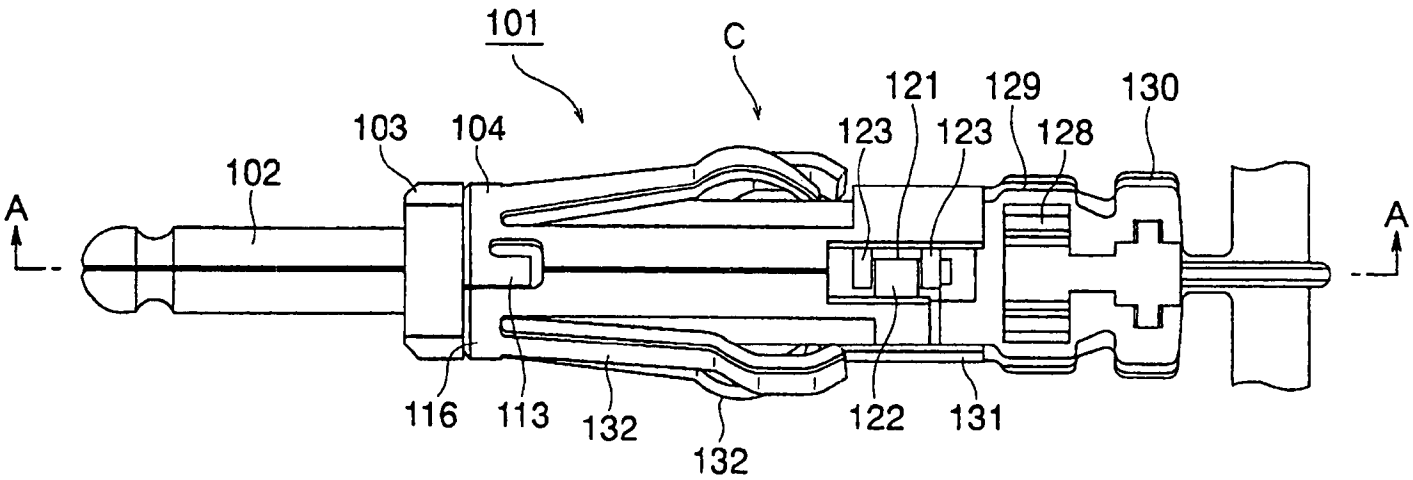
FIG. 8A PRIOR ART
FIGS. 8A and 8B are views of a conventional connector.
Figure 8B:
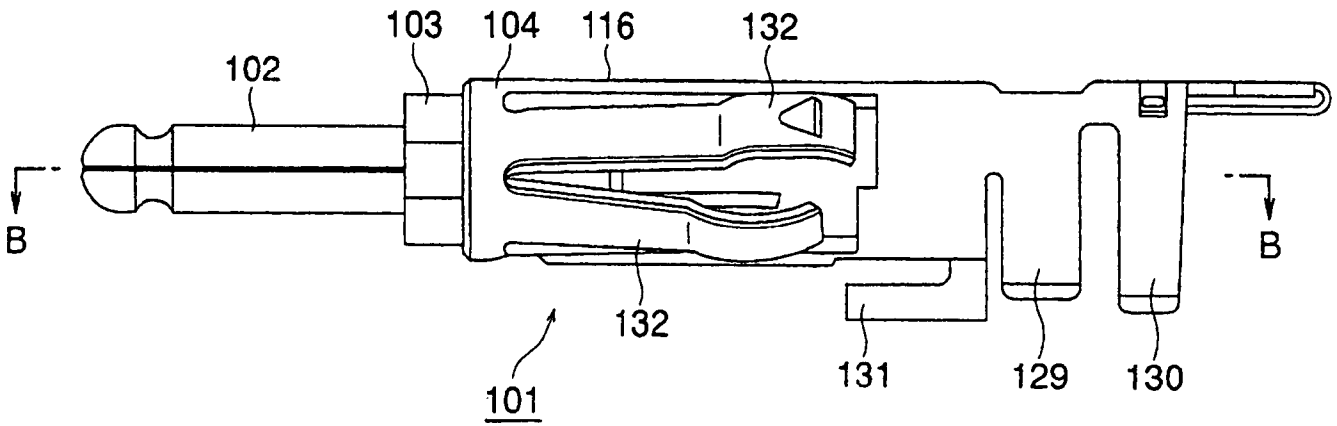
FIG. 8B PRIOR ART
Figure 9A:
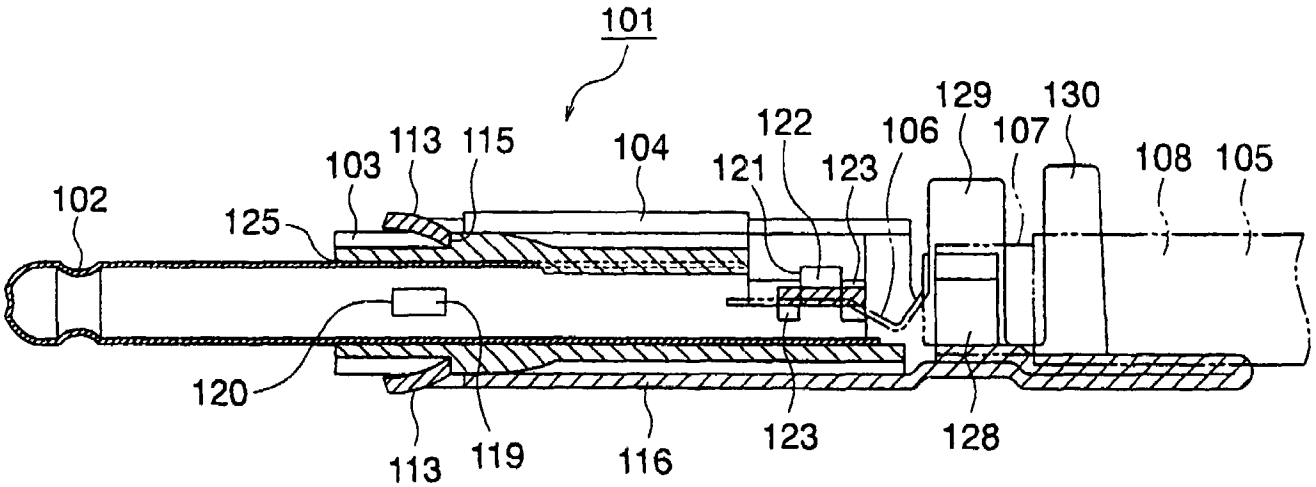
FIG. 9A PRIOR ART
FIG. 9A is a cross-sectional view taken along the line A—A of FIG. 8.
Figure 9B:
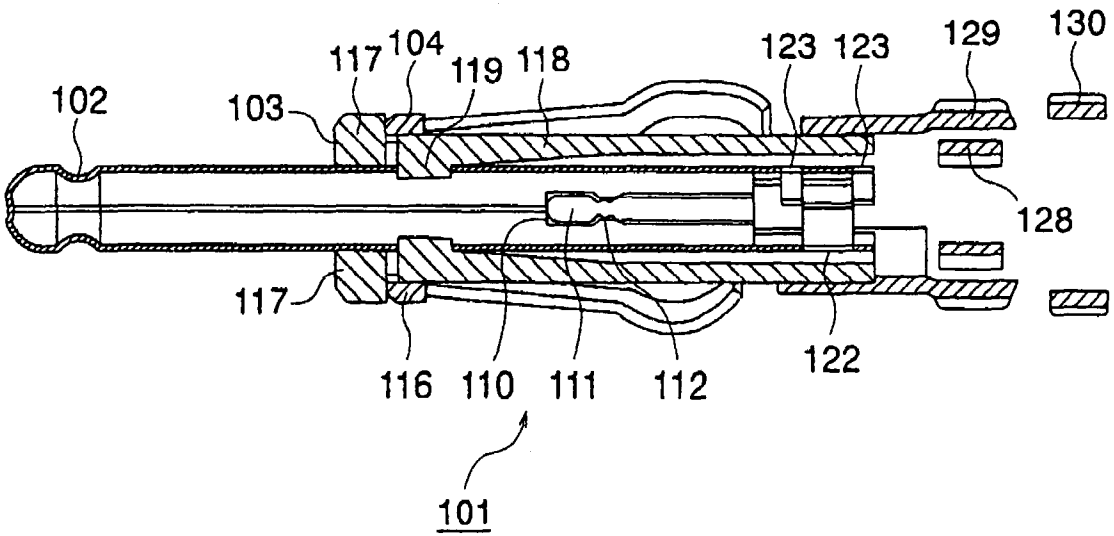
FIG. 9B PRIOR ART
FIG. 9B is a cross-sectional view taken along the line B—B of FIG. 8.
Figure 10:
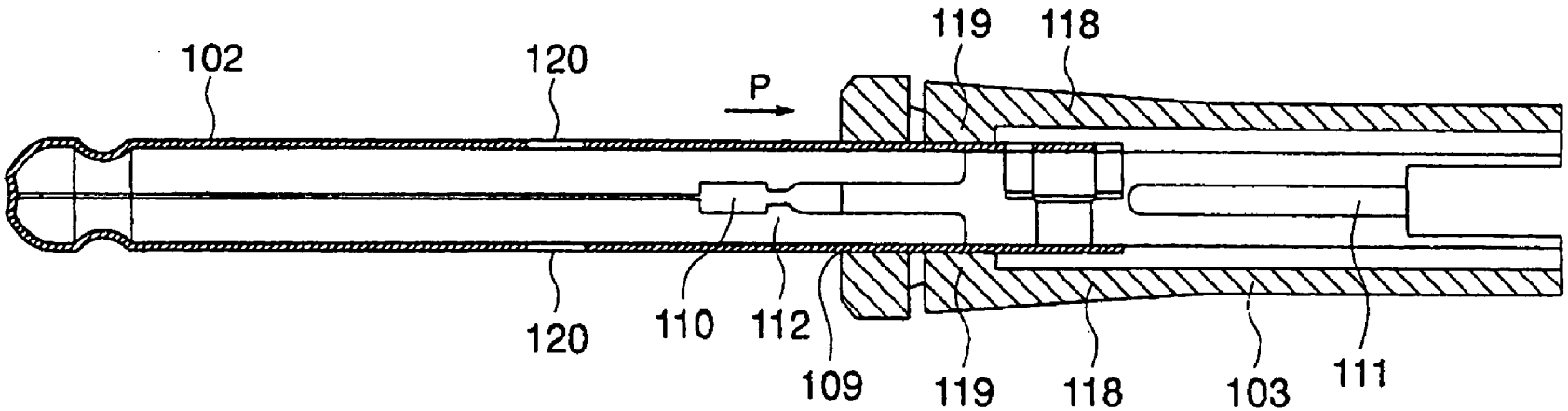
FIG. 10 PRIOR ART
FIG. 10 is a view explanatory of a procedure of assembling the conventional connector (that is, assembling a plug pin and an insulating housing together)
Figure 11:
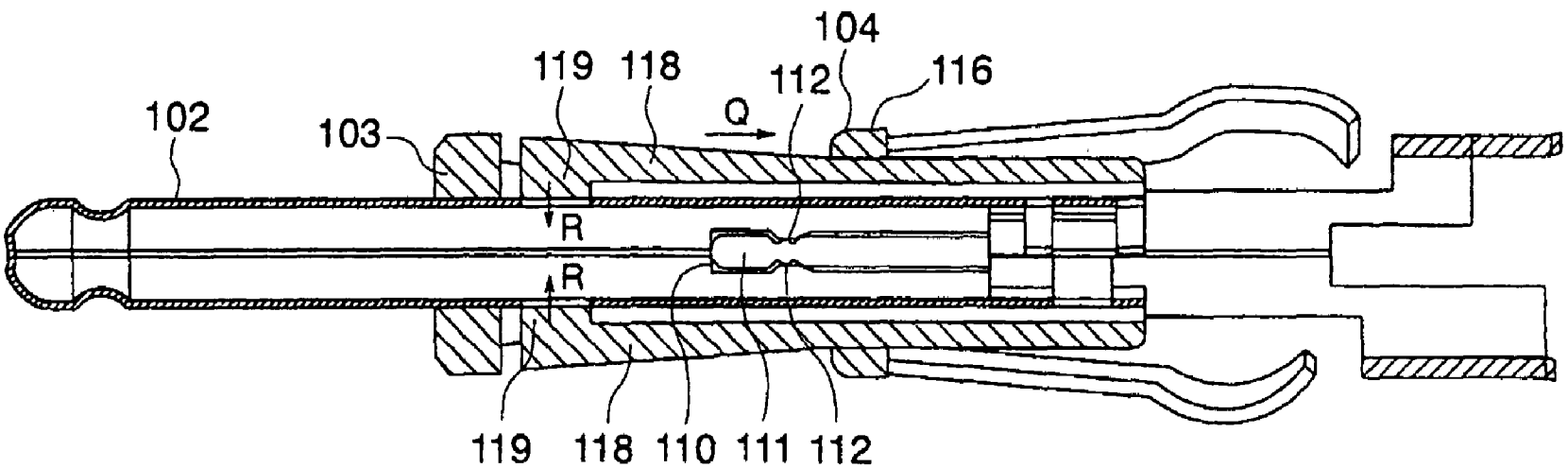
FIG. 11 PRIOR ART
FIG. 11 is a view explanatory of the procedure of assembling the conventional connector (that is, assembling the insulating housing and an outer contact together)
Figure 12A:
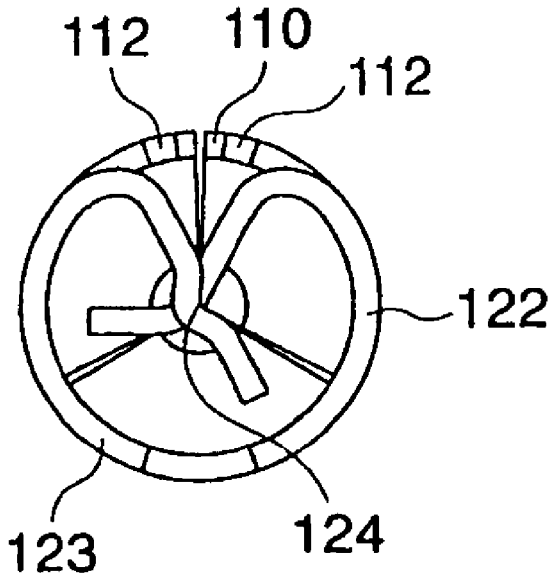
FIG. 12A PRIOR ART
FIGS. 12A and 12B are views explanatory of the structures of first and second engaging contact piece portions.
Figure 12B:
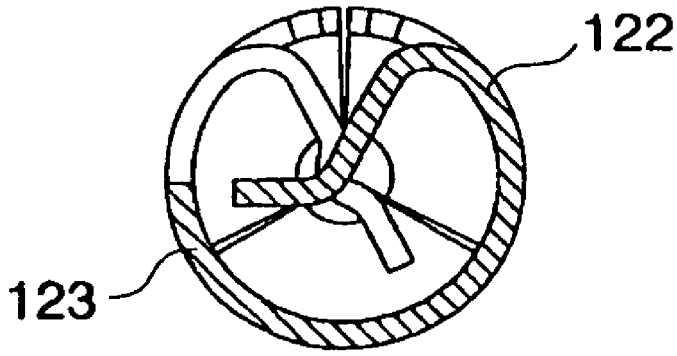
FIG. 12B PRIOR ART
Figure 13A:
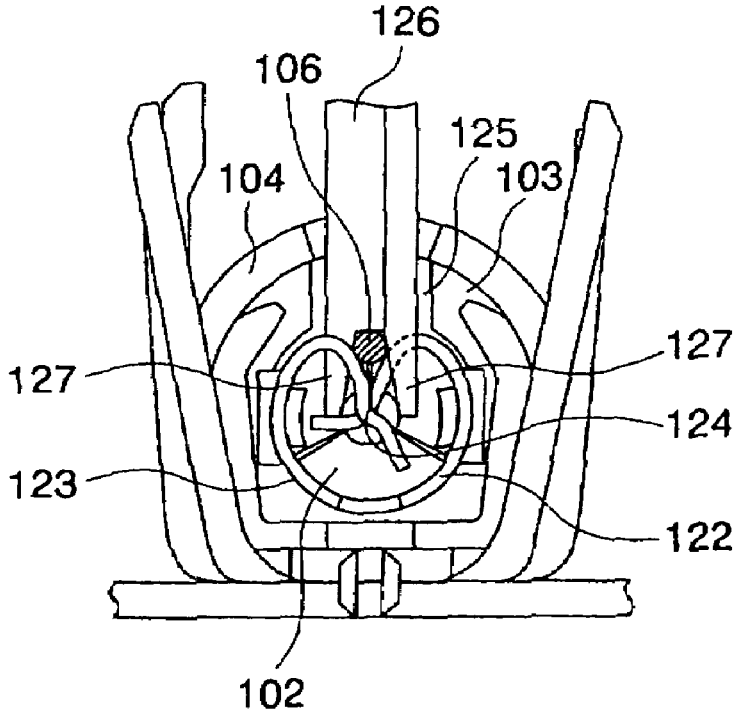
FIG. 13A PRIOR ART
FIGS. 13A and 13B are views explanatory of the connection of the conventional connector to a center conductor of a coaxial cable.
Figure 13B:
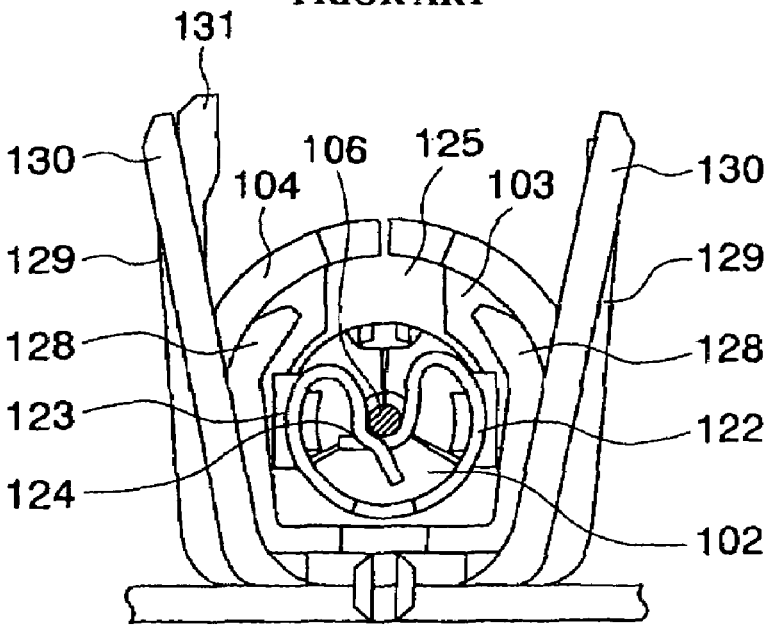
FIG. 13B PRIOR ART

FIG. 7 shows a condition in which the coaxial cable 5, having an electronic part 23 provided at the central conductor 6, is connected by press-contacting to the connector 1 of the invention.

The electronic part 23 has a pair of leads 24 which can be spread out to be spaced an angle of 180° from each other. One of the two leads 24 is fixedly connected by press-clamping to the center conductor 6. The other of the two leads 24 is fixedly connected by press-contacting to the press-contacting connecting portion 11 of the press-contacting connecting structure. As will be appreciated from FIG. 7, the connector 1 of the invention has such a structure as to be even effectively connected to the coaxial cable 5 having the electronic part 23 provided at the center conductor 6.

In the invention, various modifications can be made without departing from the subject matter of the invention. For example, the fixing structure of fixing the plug pin 2 to the insulating housing 3 can be provided alone (In this case, the conventional connecting structure is used for connecting the connector to the coaxial cable 5).

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2005-114976 filed on Apr. 12, 2005, the contents of which are incorporated herein for reference.

What is claimed is:

1. A connector, comprising an electrically conductive plug provided with a retaining hole; and an insulating housing that has a retaining member shaped in a in cantilever beam, the retaining member having a retaining claw portion, wherein the retaining claw portion has a projecting portion formed at a proximal end side of the retaining member; and wherein the projecting portion is crushed and permanently deformed by an edge portion of the retaining hole when the retaining claw portion is engaged with the retaining hole.

2. The connector according to claim 1, wherein a width of the retaining claw portion is greater than a width of the retaining hole.

3. The connector according to claim 1, wherein the edge portion of the retaining hole is chamfered.

4. The connector according to claim 1, wherein the electrically conductive plug is provided with a press-contacting connecting portion for connection to a center conductor of a coaxial cable or for connection to a lead of an electronic part connected to the center conductor.

* * * * *